US006070732A

United States Patent [19]

Chen

[11] Patent Number: 6,070,732

[45] Date of Patent: Jun. 6, 2000

[54] TOOL BOX HAVING SPRING-BIASED TOOL HOLDER

[76] Inventor: Ying Wu Chen, No. 18, Lane 9, Ming Shen Road, Gi Gi Town, Nantou Hsien, Taiwan, 552

[21] Appl. No.: 09/262,290

[22] Filed: Mar. 4, 1999

[51] Int. Cl.[7] ..... B65D 85/20

[52] U.S. Cl. ..... 206/751; 206/373; 206/378

[58] Field of Search ..... 206/736, 751, 206/752, 754, 755, 349, 372–379; 211/70.6

[56] References Cited

U.S. PATENT DOCUMENTS

| | | | |
|---|---|---|---|
| 1,859,401 | 5/1932 | Lengsfield | 206/751 |
| 4,955,478 | 9/1990 | Rau et al. | 206/372 |
| 5,368,164 | 11/1994 | Bennett et al. | 206/379 |
| 5,497,875 | 3/1996 | Kuo | 206/751 |
| 5,570,784 | 11/1996 | Sidabras et al. | 206/751 |
| 5,676,254 | 10/1997 | Cheng et al. | 206/751 |
| 5,839,579 | 11/1998 | Lee | 206/378 |

*Primary Examiner*—Paul T. Sewell
*Assistant Examiner*—Luan K. Bui
*Attorney, Agent, or Firm*—Charles E. Baxley, Esq.

[57] ABSTRACT

A tool box includes a housing having a chamber for rotatably receiving one or more tool holders each of which is pivotally secured to the housing at a pivot shaft. The tool holders may be used for holding the tool bits or the tool members. One or more springs are engaged with the tool holders for biasing the tool holders to rotate about the pivot shaft and to slightly elevate the tool members such that the tool members may be easily obtained. The tool box may include a cover for enclosing the chamber and for forcing the tool holders inward of the housing.

5 Claims, 3 Drawing Sheets

TOOL BOX HAVING SPRING-BIASED TOOL HOLDER

BACKGROUND OF THE INVENTION

1. Field of the Invention

The present invention relates to a tool box, and more particularly to a tool box having a tool holder that may be automatically biased and opened when the tool box is opened.

2. Description of the Prior Art

Typical tool boxes comprise a chamber formed therein for receiving the tool bits or tool members. Some of the tool boxes may further include one or more tool holders disposed in the tool box for receiving and holding the tool bits or the tool members. However, the tool bits and/or the tool members may not be easily obtained with such a tool holder.

The present invention has arisen to mitigate and/or obviate the afore-described disadvantages of the conventional tool boxes.

SUMMARY OF THE INVENTION

The primary objective of the present invention is to provide a tool box having a tool holder that may be automatically biased and opened when the tool box is opened, for allowing the tool bits and the tool members to be easily obtained.

In accordance with one aspect of the invention, there is provided a tool box comprising a housing including a chamber formed therein, at least one tool holder pivotally secured to the housing at a pivot shaft and received in the chamber of the housing, the tool holder including means for holding tool members, and means for biasing the tool holder to rotate about the pivot shaft and to allow the tool members to be easily obtained.

The tool holder includes at least one projection extended therefrom, the biasing means includes a spring engaged on the pivot shaft and engaged with the projection of the tool holder for biasing the tool holder to rotate about the pivot shaft.

A cover is further attached to the housing for enclosing the chamber. The tool holder includes a bulge formed thereon for engaging with the cover and for protecting the cover from being damaged.

The tool holder includes a plurality of openings formed therein for receiving the tool members, or includes a plurality of pins extended therefrom for engaging with and for holding the tool members in place.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
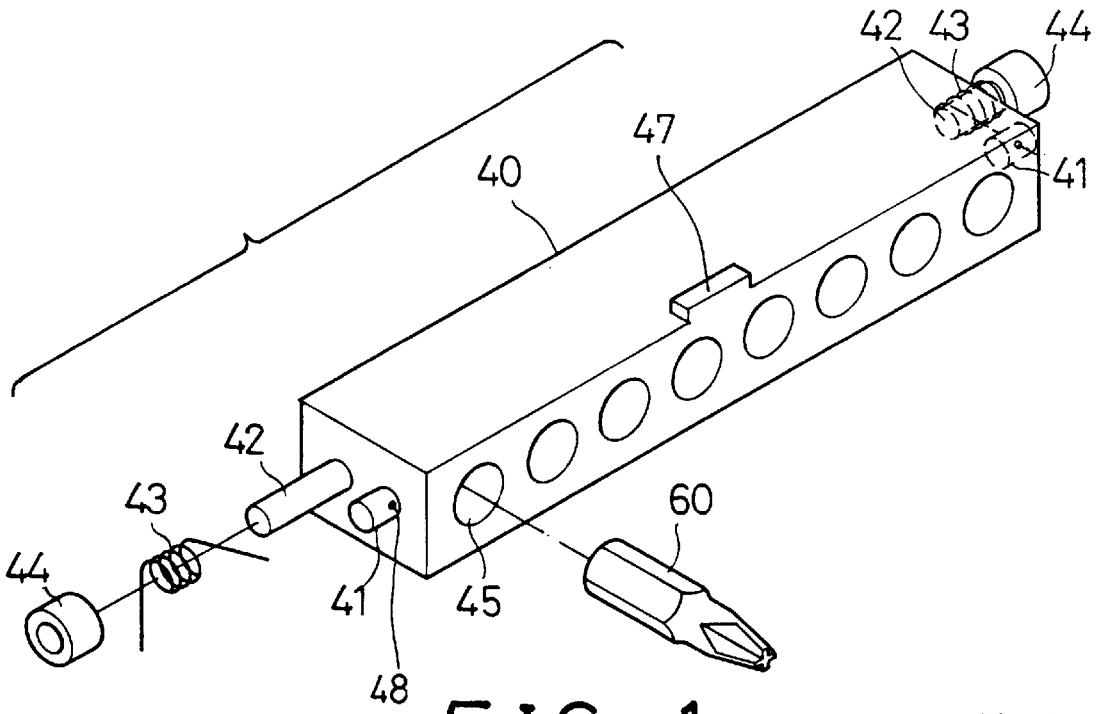
FIG. 1 is an exploded view of a tool holder for a tool box in accordance with the present invention.
Figure 5:
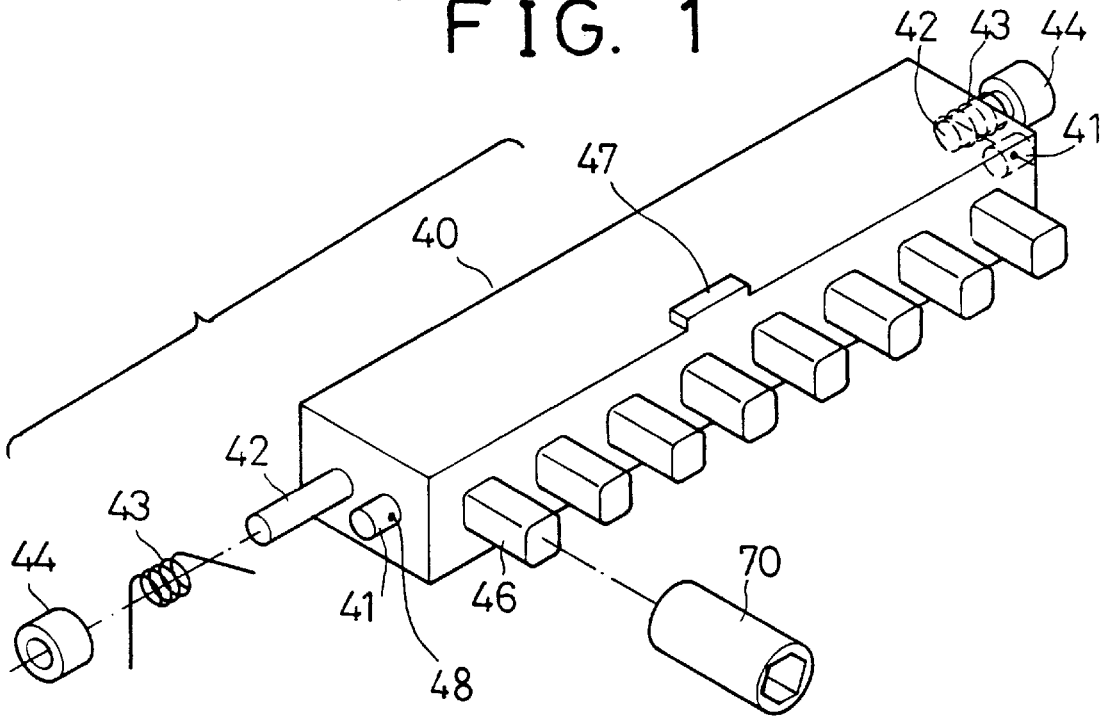
FIG. 5 is an exploded view similar to FIG. 1 illustrating the other application of the tool holder.
Figure 2:
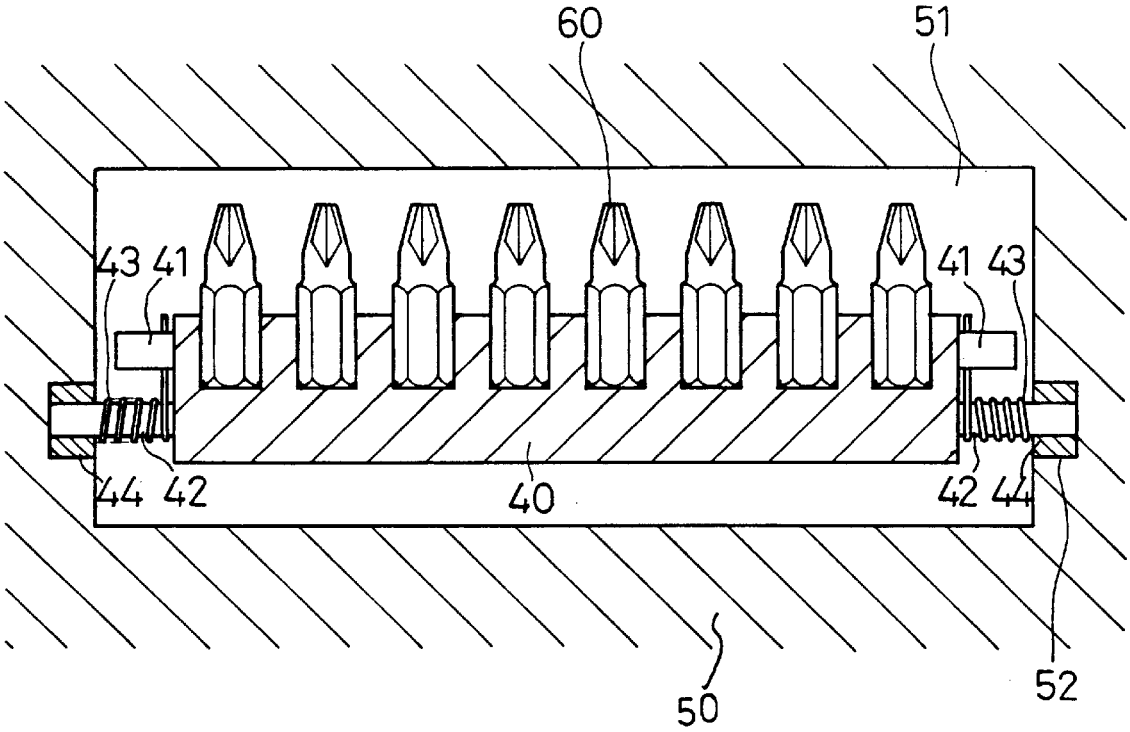
FIG. 2 is a partial cross sectional view of the tool box.

Referring to the drawings, and initially to FIGS. 1–4, a tool box in accordance with the present invention comprises a housing 50 including a chamber 51 formed therein for receiving one or more tool holders 40 and including one or more cavities 52 (FIG. 2) a formed therein for receiving the bearings or the bushings 44. The tool holder 40 is pivotally secured to the housing 50 with a pivot shaft 42 that is rotatably secured to the housing 50 with the bearings 44. The tool holder 40 includes one or more projections 41 extended therefrom and having an aperture 48 formed therein, and includes a number of openings 45 formed therein for receiving the tool members or the tool bits 60. The tool holder 40 may also include one or more pins 46 (FIG. 5) extended therefrom for engaging with and for holding the other tool members, such as the sockets 70. One or more springs 43 are engaged on the pivot shaft 42 and each includes one end engaged through the aperture 48 of the projection 41 of the tool holder 40 and each includes the other end engaged with the housing 50 (FIG. 3) for applying a biasing force against the tool holder 40 and for biasing the openings 45 and the tool bits 60 or the tool members 70 slightly upward.

Figure 3:
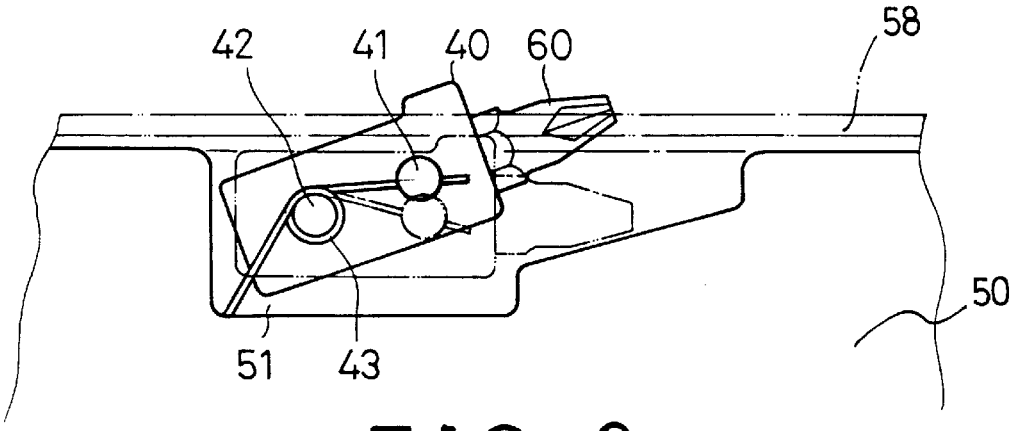
FIG. 3 is a schematic view illustrating the operation of the tool holder of the tool box.
Figure 4:
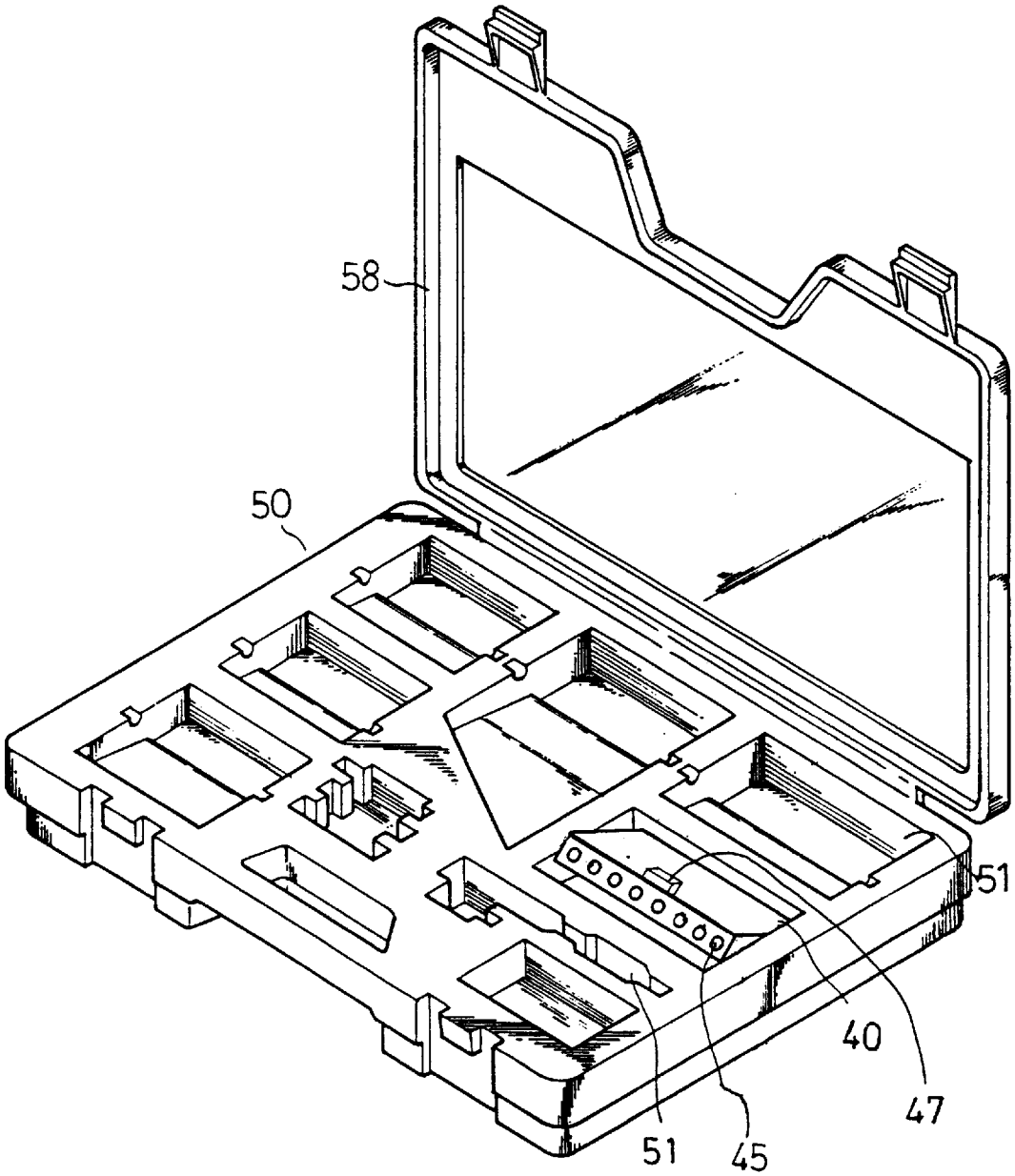
FIG. 4 is a perspective view of the tool box.

As best shown in FIG. 3, the tool holder 40 may be forced inward of the chamber 51 of the housing 50, as shown in dotted lines, when the cover 58 of the tool box is engaged onto the housing 50. When the cover 58 is removed or opened, the spring(s) 43 may bias the tool holder 40 to rotate about the pivot shaft 42 and may slightly move the tool bits 60 or the tool members 70 upward, as shown in solid lines in FIG. 3, for allowing the tool bits 60 or the tool members 70 to be easily engaged onto the tool holder 40 and to be easily removed from the tool holder 40. It is preferable that the tool holder 40 includes a bulge 47 for engaging with the cover 58. The bulge 47 may be made as a separate element from the tool holder 40 and may be made of soft or resilient material for forming as a pad device and for preventing the cover 58 from being damaged by the bulge 47.

It is to be noted that the housing 50 may also be made as a drawer and may be slidably engaged in a casing or a desk, such that the tool holder 40 may also be forced inward of the chamber 51 of the housing 50 by the casing instead of being actuated by the cover 58.

Accordingly, the tool box in accordance with the present invention includes a tool holder that may be automatically biased and opened when the tool box is opened, for allowing the tool bits and the tool members to be easily obtained.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool box comprising:

a housing including a chamber formed therein, at least one tool holder pivotally secured to said housing at a pivot shaft and received in said chamber of said housing, said at least one tool holder including means for holding tool members and including at least one projection extended therefrom, and means for biasing said at least one tool holder to rotate about said pivot shaft and to allow the tool members to be easily obtained, said biasing means including a spring engaged on said pivot shaft and engaged with said at least one projection of said at least one tool holder for biasing said at least one tool holder to rotate about said pivot shaft.

2. The tool box according to claim 1 further comprising a cover attached to said housing for enclosing said chamber.

3. The tool box according to claim 2, wherein said at least one tool holder includes a bulge formed thereon for engaging with said cover.

4. The tool box according to claim 1, wherein said means for holding tool members includes a plurality of openings formed therein for receiving said tool members.

5. The tool box according to claim 1, wherein said means for holding tool members includes a plurality of pins extended therefrom for engaging with and for holding said tool members in place.

* * * * *